US009375959B2

(12) United States Patent
Liggett et al.

(10) Patent No.: US 9,375,959 B2
(45) Date of Patent: Jun. 28, 2016

(54) LOCKING MECHANISM FOR AN ENCODER STRIP

(75) Inventors: Melinda Lois Liggett, Atherton, CA (US); John Patrick Sturman, Portland, OR (US); Justin M Roman, Portland, OR (US); Anthony Carcia, Portland, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 93 days.

(21) Appl. No.: 13/598,077

(22) Filed: Aug. 29, 2012

(65) Prior Publication Data

US 2014/0064816 A1 Mar. 6, 2014

(51) Int. Cl.
*B41J 19/20* (2006.01)

(52) U.S. Cl.
CPC ..... *B41J 19/207* (2013.01); *Y10T 403/602* (2015.01)

(58) Field of Classification Search
CPC ..... B41J 19/205; B41J 19/207
USPC ..... 347/37; 400/352, 355, 283, 705
See application file for complete search history.

(56) References Cited

U.S. PATENT DOCUMENTS

| | | | | |
|---|---|---|---|---|
| 2,325,691 | A | 8/1943 | Litwin et al. | |
| 3,938,721 | A | 2/1976 | Staneck et al. | |
| 4,605,970 | A * | 8/1986 | Hawkins | 358/406 |
| 4,944,617 | A | 7/1990 | Tribert | |
| 5,581,952 | A * | 12/1996 | Kapes et al. | 49/502 |
| 6,254,292 | B1 | 7/2001 | Navarro | |
| 6,907,356 | B2 * | 6/2005 | Swenson et al. | 702/35 |
| 6,951,335 | B2 | 10/2005 | Elgee et al. | |
| 7,775,629 | B2 | 8/2010 | Nukui et al. | |
| 7,992,869 | B2 | 8/2011 | Terada | |
| 2007/0263051 | A1 | 11/2007 | Kawai et al. | |
| 2009/0027438 | A1 * | 1/2009 | Tanaka et al. | 347/19 |
| 2011/0050783 | A1 | 3/2011 | Komuro | |

FOREIGN PATENT DOCUMENTS

| | | | | |
|---|---|---|---|---|
| JP | 63077772 | A * | 4/1988 | B41J 19/18 |
| JP | 2000289281 | A * | 10/2000 | B41J 19/20 |
| JP | 2007045006 | | 2/2007 | |

OTHER PUBLICATIONS

Webpage. Service Station Disassembly & Repair. Fixyourownprinter.com. http://fatrcat.com/7100ss.html. Aug. 10, 2008.

* cited by examiner

*Primary Examiner* — Daniel J Colilla
*Assistant Examiner* — Ruben Parco, Jr.
(74) *Attorney, Agent, or Firm* — Tarolli, Sundheim, Covell & Tummino LLP

(57) ABSTRACT

An apparatus can comprise a locking mechanism comprising an elongated slot to receive a pin. The apparatus can also comprise an encoder strip adhered to the locking mechanism. The apparatus can further comprise a tension spring coupled to the locking mechanism. The tension spring can provide a force in a given direction to pull the locking mechanism in the given direction.

9 Claims, 5 Drawing Sheets

LOCKING MECHANISM FOR AN ENCODER STRIP

BACKGROUND

A linear encoder (or simply an encoder) is a sensor, transducer or readhead paired with a scale that encodes position. The sensor reads the scale in order to convert the encoded position into an analog or digital signal, which can then be decoded into position by a digital readout (DRO) or motion controller.

A plotter is a computer printer that can be employed to print vector graphics. A plotter can be implemented as an inkjet plotter. An inkjet plotter can print by moving an inkjet nozzle (or an array of inkjet nozzles) or other instrument across a surface of a piece of paper. Inkjet plotters can draw complex line art, including text.

DETAILED DESCRIPTION

The present disclosure includes a system that can control stress on an encoder strip. In one example, the system can include a locking mechanism with a slot that is adhered to the encoder strip. The slot of the encoder strip can receive a pin. The locking mechanism can be coupled to a tension spring. The locking mechanism can initially be positioned such that the pin is slightly removed from an edge of the slot. The tension spring can apply a relatively constant force (e.g., a tension) in a given direction which can cause a stress on the encoder strip. The stress on the encoder strip can cause a relatively small amount of creep in the encoder strip over a relatively long period of time. The creep in the encoder strip can cause the locking mechanism to move relative to the pin, such that the pin is nested in a given edge of the encoder strip, thereby relieving some of the stress on the encoder strip. Relieving the stress on the encoder strip can reduce further creep of the encoder strip.

Figure 1:
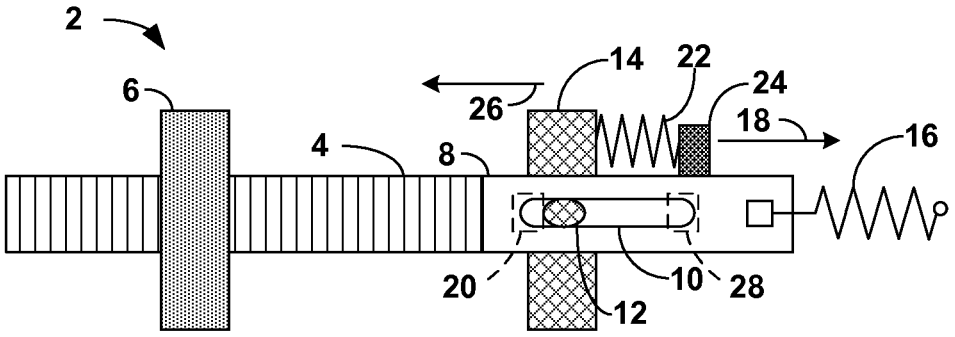
FIG. 1 illustrates an example of a system to control stress on an encoder strip.

FIG. 1 illustrates an example of a system 2 to control stress on an encoder strip 4. The encoder strip 4 can be formed from a translucent material. Moreover, the encoder strip 4 can be formed from a material such as a polymer. In some examples, the encoder strip 4 can be formed from a material such as Biaxially-oriented polyethylene terephthalate (BoPET).

The encoder strip 4 can include a periodic series of darkened lines. An encoder reading mechanism 6 can be positioned to detect each of the darkened lines. In one example, the encoder reading mechanism 6 can include an emitter and a detector. In such a situation, the emitter can transmit an optical signal through the encoder strip 4, which optical signal can be detected by the detector. If a portion of the encoder strip 4 that includes one of the darkened lines crosses a path of the optical signal, the optical signal between the emitter and detector would be broken, and the detector could provide an output signal indicative of the break in the optical signal. By providing the encoder strip 4 at a known length and a known distance between the series of periodic lines, counting be number of times that the optical signal between the emitter and detector is broken can be employed to determine a position of the encoder reading mechanism 6 relative to the encoder strip 4. In some examples, determination of the position of the encoder mechanism relative to the encoder strip 4 can be employed to derive a physical position of a component (e.g., a print head) that houses the encoder reading mechanism 6.

The encoder strip 4 can be adhered to a locking mechanism 8. In some examples, the encoder strip can be adhered to the locking mechanism 8 by an acrylic pressure sensitive adhesive (PSA). The locking mechanism 8 can be formed, for example, with metal. The locking mechanism 8 can include a slot 10 that receives a pin 12 that can be coupled to a guide 14. The pin 12 can have an oval shape or a round shape. The guide 14 can be stationed at a relatively static position. Moreover, a tension spring 16 can be coupled to the locking mechanism 8 and can apply a force on the locking mechanism 8 in a direction indicated by the arrow 18. The force on the locking mechanism 8 can cause a stress on the encoder strip 4.

Figure 2:
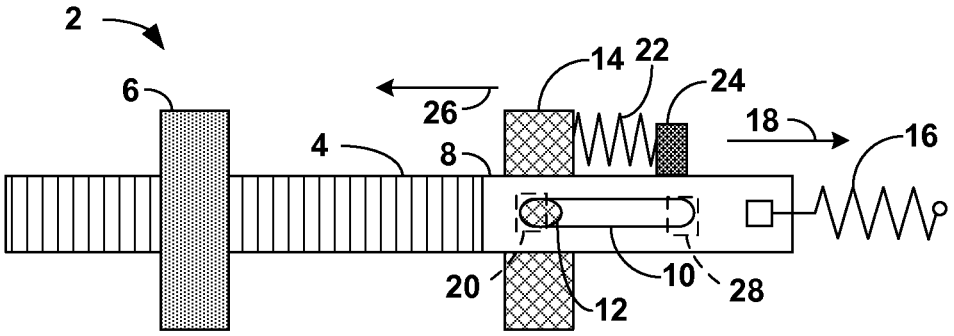
FIG. 2 illustrates the system of FIG. 1 after creep of an encoder strip has occurred.

Application of the stress on the encoder strip 4, over a relatively long period of time (e.g., 1-8 weeks or more), can cause the encoder strip 4 to experience creep. As used herein, "creep" denotes the tendency of a solid material to move slowly or deform permanently under the influence of stresses. Creep can occur as a result of long term exposure to relatively high levels of stress that are below a yield strength of the material. As the encoder strip 4 experiences creep, the encoder strip 4 can expand by a small amount in the direction indicated by the arrow 18. Upon such an expansion, with continued application of the force in the direction indicated by the arrow 18, the locking mechanism 8 can move relative to the pin 12 until the pin 12 abuts a rounded edge 20 of the slot 10 such that the pin 12 is nested in the rounded edge 20 of the slot 10. FIG. 2 illustrates an example of the system 2 illustrated in FIG. 1, wherein the pin 12 is nested in the rounded edge 20 of the slot 10 of the locking mechanism 8. For purposes of simplification of explanation, the same reference numbers are employed in FIGS. 1 and 2 to denote the same structure.

In some examples, the system 2 can include a compression spring 22 that can be anchored to a rigid member 26 with a static position, such as an element of a printer assembly sidewall. The compression spring 22 can apply a compression force in a direction indicated by the arrow 26 on the guide 14. The compression force applied by the compression spring 22 can force the guide 14 in the direction indicated by arrow 26 until the pin 12 is nested in the rounded edge 20 of the slot 10 of the locking mechanism 8. Inclusion of the compression spring 22 can further alleviate creep of the encoder strip 4, particularly during the initial application of the tension by the tension spring 16.

Upon nesting the pin 12 into the rounded edge 20 of the slot 10 of the locking mechanism 8, stress on the encoder strip 4 caused by the force of the tension spring 16 can be reduced and/or relieved significantly. Accordingly, the creep of the encoder strip 4 can be reduced and/or eliminated. Reduction and/or elimination of the creep of the encoder strip 4 can ensure that the distance between the darkened lines of the encoder strip 4 stay relatively uniform. Therefore, the system 2 can extend the useful life of the encoder strip 4.

Additionally, in some environments of application, such as employing the system 2 in a printer, such as a plotter, paper jams may occur. In such a situation, it is common for a user to pull the encoder strip 4 in a direction indicated by the arrow 26. The slot 10 of the locking mechanism 8 can be large enough to allow the locking mechanism 8 to move in the direction indicated by the arrow 26 until the pin 12 is nested in another rounded edge 28 of the slot 10 of the locking mechanism 8.

The system 2 can be installed in environments where a relatively small form factor is needed since the encoder strip 4 does not need to be adhered to a stiffener material, such as metal. Additionally, by avoiding the employment of such a relatively expensive stiffener material, significant cost savings can be achieved.

Figure 3:
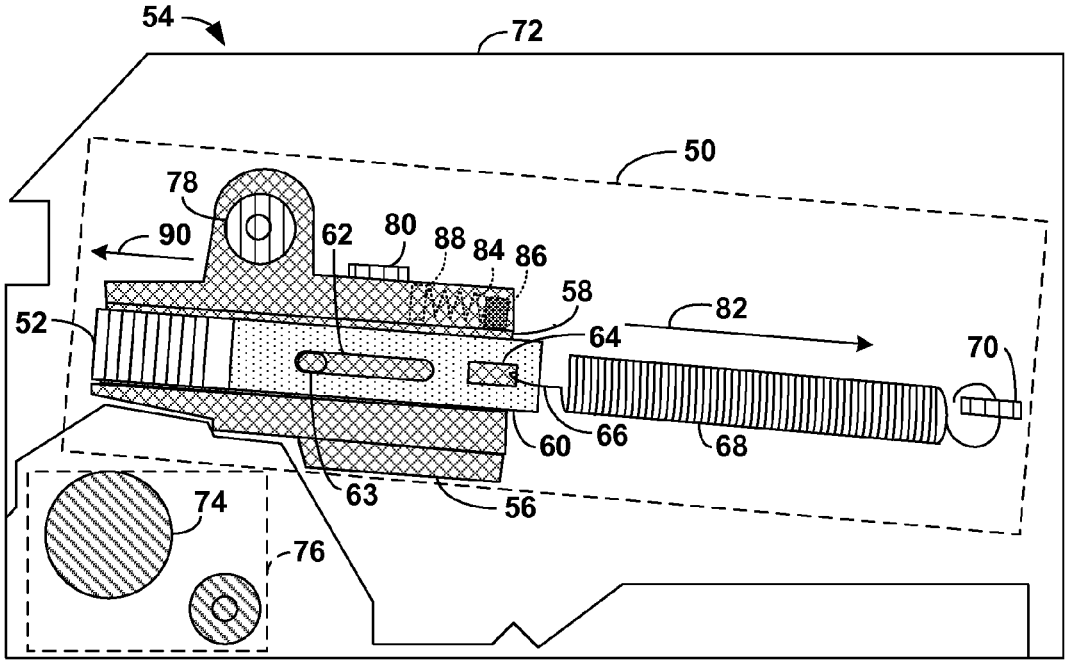
FIG. 3 illustrates another example of a system, such as the system of FIG. 1, to control stress on an encoder strip.

FIG. 3 illustrates an example of a system 50, such as the system 2 of FIG. 1, to control stress on an encoder strip 52 that is installed on a printer 54. The printer 54 can be, for example, a large format printer, such as a plotter (e.g., an inkjet plotter). In some examples, the printer 54 can print on sheets of paper that are about 609 mm (24 inches) or more wide. The encoder strip 52 can be formed from a relatively flexible material, such as BoPET. The system 50 can include a guide 56 to align the encoder strip 52. The guide 56 can be formed, for example, from a relatively rigid material, such as plastic. The guide 56 can include a U-shaped region 58 for aligning a locking mechanism 60 and the encoder strip 52.

The encoder strip 52 can be adhered to the locking mechanism 60 (e.g., by a PSA) and the locking mechanism 60 can be formed from rigid material that has a relatively small amount of creep, such as metal. The encoder strip 52 can be transparent or translucent. The encoder strip 52 can include a series of periodic dark lines that can be detected by an encoder reader mechanism, such as the encoder reader mechanism 6 described with respect to FIG. 1 to determine a position of a print head of the printer 54.

The locking mechanism 60 can include an elongated slot 62 to receive a pin 63 protruding in a perpendicular direction from the guide 56. The pin 63 can be oval or round shaped. Moreover, the slot 62 can be oval shaped and can have edges that can nest the pin 63 (e.g., rounded edges). The locking mechanism 60 can include an aperture 64 for receiving a hook 66 of a tension spring 68. The tension spring 68 can be anchored to a tongue 70 protruding perpendicularly from a printer assembly of the printer 54. In some examples, the printing assembly can be a main case of the printer 54. The encoder strip 52 can be bent and extended through an aperture in a sidewall 72 of the printer assembly such that the encoder strip 52 extends along a top region of a carriage rod 74 that protrudes through the sidewall 72 of the printer assembly. The carriage rod 74 can be included in a carriage assembly 76 of the printer 54.

The guide 56 can be mechanically fastened to the sidewall 72 of the printing assembly of the printer 54. The guide 56 can be fastened to the sidewall 72, for example, by a fastener 78, such as a screw or a rivet. Additionally, a position of the guide 56 relative to the printer assembly can be controlled by adjustment of an aligning mechanism 80, which can be implemented as a screw. Changing the position of the guide 56 can change the position of the pin 63 relative to the locking mechanism 60.

The tension spring 68 can provide a relatively constant force in the direction indicated by the arrow 82. The force applied by the tension spring 68 can apply tension on the locking mechanism 60, which can apply a stress on the encoder strip 52. In some examples, the guide 56 can be positioned such that the pin 63 is near but not touching the edge of the slot 62 of the locking mechanism 60. In such a situation, the stress on the encoder strip 52 can eventually (e.g., over the course of several weeks) cause creep of the encoder strip 52 in the direction indicated by the arrow 82 thereby causing the pin 63 to nest at the edge of the slot 62 of the locking mechanism 60.

Additionally, in other examples, the system 50 can include a compression spring 84 that can be anchored to a tongue 86 protruding from the sidewall 72 of the printer assembly of the printer 54. The compression spring 84 can also be coupled to a tongue 88 protruding from the guide 56. The compression spring 84, the tongue 86 protruding from the sidewall 72 and the tongue 88 protruding from the guide 56 can be hidden from view by the guide 56, as indicated by the dotted lines employed in FIG. 3. The compression spring 84 can apply a compression force in a direction indicated by the arrow 84 on the guide 56. The compression force applied by the compression spring 84 can force the guide in the direction indicated by arrow 90 until the pin 63 is nested in the rounded edge of the slot 62 of the locking mechanism 60. Upon the pin 63 nesting in the rounded edge of the slot 62 of the locking mechanism 60, the aligning mechanism 80 can be actuated to set the guide 56 in a static position relative to the sidewall 72. Inclusion of the compression spring 84 can further alleviate creep of the encoder strip 4, particularly during the initial application of the tension by the tension spring 68.

Once the pin 63 nests at the edge of the slot 62 of the locking mechanism 60, the stress on the encoder strip 52 can be significantly reduced which can reduce and/or eliminate the creep of the encoder strip 52. Additionally, during the employment of the printer 54, mechanical faults, such as paper jams may occur. In such a situation, it is common that a user may attempt to clear the paper jam. In an effort to clear the paper jam, the encoder strip 52 may be pulled by the user in a direction indicated by the arrow 90. Such a pull by the user can cause the slot 62 of the locking mechanism 60 to move relative to the pin 63 in a direction indicated by the arrow 90, such that the paper jams can be removed without damage to the encoder strip 52 and/or the locking mechanism 60.

Employment of the system 50 can alleviate the creep that can be caused by constant stress on the encoder strip 52 since the locking mechanism 60 reduces the stress applied to the encoder strip 52 once the pin 63 is nested in edge of the slot 62 of the locking mechanism 60. Further, the encoder strip 52 does not need to be adhered to an expensive and/or unwieldy stiffener such that the encoder strip 52 can be produced relatively inexpensively and with a relatively small form factor. Moreover, damage to the encoder strip 52 from pulling the encoder strip 52 can be prevented since the slot 62 in the locking mechanism 60 allows movement in the direction indicated by the arrow 90.

Figure 4:
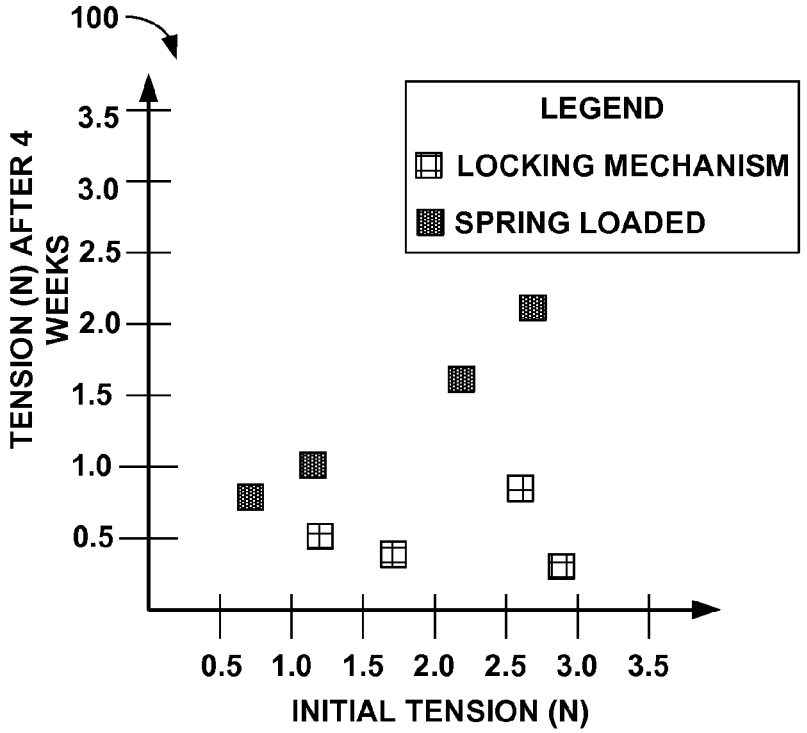
FIG. 4 illustrates an example of a graph that plots a tension on an encoder strip, such as the encoder strip included in the system of FIG. 1, after four weeks as a function of an initial tension on the encoder strip.

FIG. 4 illustrates an example of a graph 100 that depicts a tension in newtons (N) caused by a tension spring that induces a stress on an encoder strip after about 4 weeks plotted as a function of an initial tension in newtons (N). A first system (labeled in FIG. 4 as "LOCKING MECHANISM"), can include a locking mechanism such as the system 2 illustrated in FIG. 1. Moreover, a second system (labeled in FIG. 4 as "SPRING LOADED") can omit the locking mechanism, such that a constant force is applied to an encoder strip via a tension spring. As illustrated in FIG. 4, by inclusion of the locking mechanism a significant reduction in the tension experienced by the encoder strip can be achieved after about 4 weeks.

Figure 5:
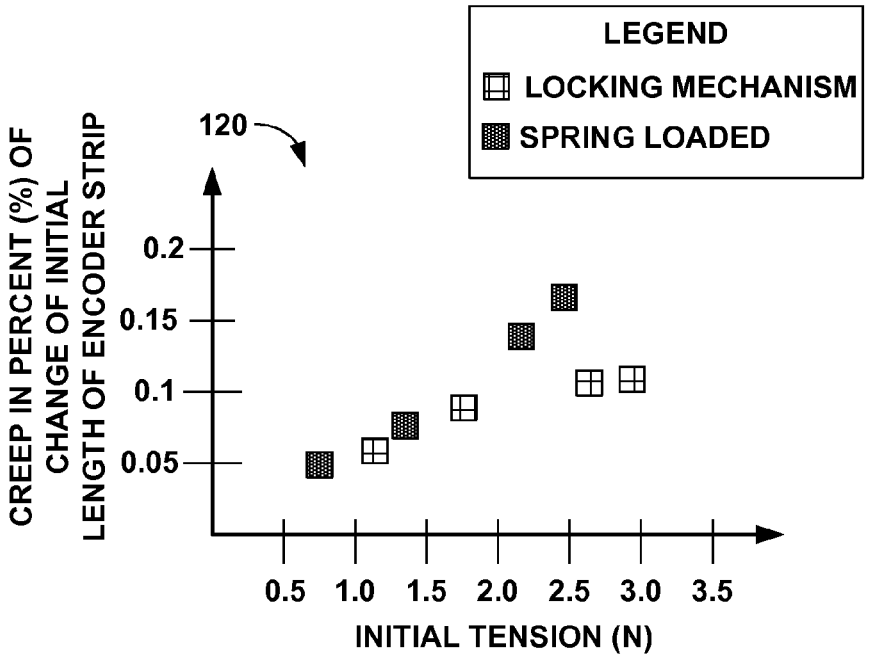
FIG. 5 illustrates an example of a graph that plots creep on an encoder strip, such as the encoder strip included in the system of FIG. 1, after four weeks as a function of an initial tension on the encoder strip.

FIG. 5 illustrates a graph 120 that depicts a creep, in percentage (%) of change of an initial length of an encoder strip after about 4 weeks plotted as a function of an initial tension in newtons (N) caused by a tension spring. A first system (labeled in FIG. 4 as "LOCKING MECHANISM") can include a locking mechanism, such as the system 2 illustrated in FIG. 1. Moreover, a second system (labeled in FIG. 4 as "SPRING LOADED") can omit the locking mechanism, such that a constant force is applied to an encoder strip via a tension spring. As illustrated in FIG. 4, by inclusion of the locking mechanism a significant reduction in creep of the encoder strip can be achieved after about 4 weeks.

Figure 6:
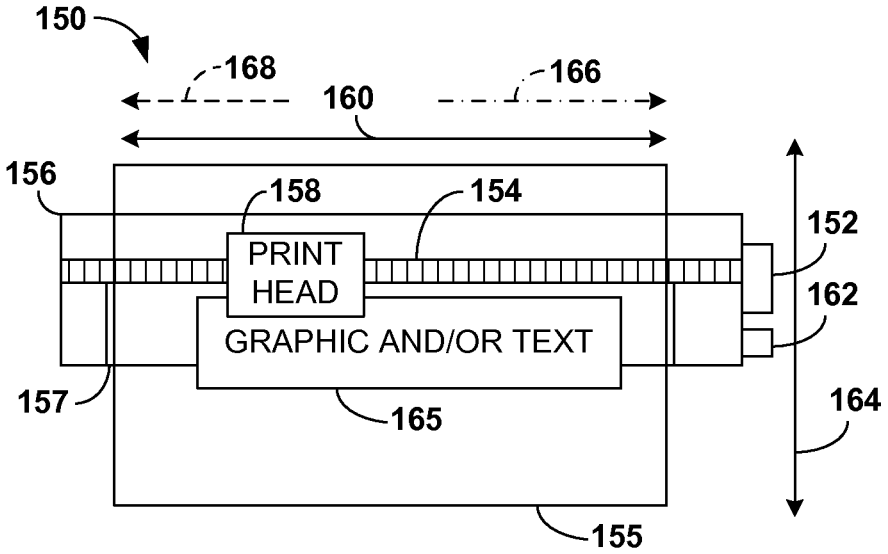
FIG. 6 illustrates an example printer with a system, such as the system of FIG. 1, to control stress on an encoder strip installed thereon.

FIG. 6 illustrates an example of a printer 150 that has a system 152 (e.g., the system 2 of FIG. 1) to control stress on an encoder strip 154 installed thereon. In some examples, the printer 150 can be implemented, for example, as a large format printer (LFP) that can print to paper 155 that is about 609 mm (24 inches) or less. In other examples, the printer 150 can be designed to print to even larger (or smaller) sheets of paper 155. In some examples, the printer 150 can be implemented as a plotter (e.g., an inkjet plotter).

The printer 150 can have a main case 156 that includes a paper tray 157 for holding and aligning the paper 155. In FIG. 6, the paper 155 is shown as being transparent, but is to be understood that in other examples, the paper 155 can be opaque. Moreover, although the paper 155 is shown as being a flat sheet, in other examples, a portion of the paper 155 can be on a roll of paper. The system 152 can be mechanically fastened to a side wall of the main case 156. The encoder strip 154 can extend along a front portion of the main case 156 and bend back towards the system 152. The encoder strip 154 can be formed from a flexible material such as BoPET.

A print head 158 of the printer 150 can move in a first linear direction relative to the main case 156, wherein the first linear direction can be indicated by arrows 160. The print head 158 can include an encoder reading mechanism to read darkened lines on the encoder strip 154 to determine a position of the print head 158 relative to the encoder strip 154. Additionally, the printer 150 can include a roller assembly 162 that can move the paper 155 in a second linear direction relative to the main case 156, wherein the second linear direction can be indicated by arrows 164. Moreover, the first and second directions can be perpendicular to each other. The print head 158 can include a printing mechanism (e.g., an inkjet nozzle) that can print a graphic and/or text 165 on the paper 155.

As explained herein, the system 152 can include a locking mechanism with a slot that is adhered to the encoder strip 154. The slot can house a pin extending perpendicularly from a guide in the system 152. The locking mechanism can be coupled to a tension spring. The locking mechanism can initially be positioned such that the pin is slightly removed from a given edge of the slot or touching the given edge of the slot, particularly if a compression spring (e.g., the compression spring 22 of FIG. 1) is included. The tension spring can apply a relatively constant force in a direction indicated by the arrow 166, which can cause a stress on the encoder strip 154. In some examples, the stress on the encoder strip 154 can cause a relatively small amount of creep in the encoder strip 154 over a relatively long period of time. The creep in the encoder strip 154 can cause the locking mechanism to move relative to the pin, such that the pin is nested in the given edge of the locking mechanism, thereby relieving some of the stress on the encoder strip 154. In other examples, the compression spring can cause the pin to be initially nested in the given edge of the locking mechanism, thereby relieving some of the stress on the encoder strip 154. Relieving the stress on the encoder strip 154 can reduce and/or eliminate the creep of the encoder strip 154.

Additionally, occasionally a paper jam may occur. During a paper jam, the main case 156 of the printer 150 may be partially disassembled to remove the paper 155. In such a situation, the encoder strip 154 may be pulled in a direction indicated by the arrow 168. As explained herein, the slot of the locking mechanism of the system 152 can be sized so as to allow the locking mechanism to move relative to the pin in such that the encoder strip 154 can move in the direction indicated by the arrow 168.

Figure 7:
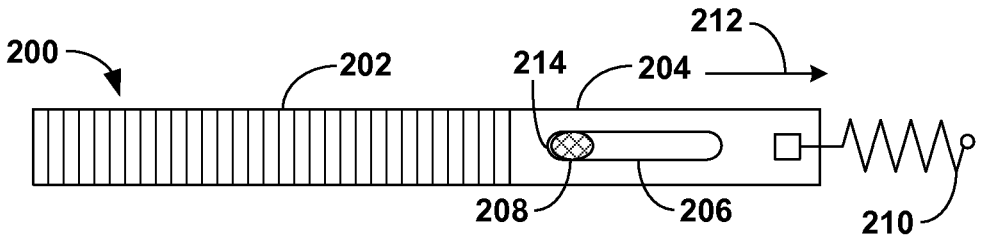
FIG. 7 illustrates an example of an apparatus, such as the system of FIG. 1, to control stress on an encoder strip.

FIG. 7 illustrates an example of an apparatus 200 (e.g., the system 2 illustrated in FIG. 1) that can control stress on an encoder strip 202. The apparatus 200 can include a locking mechanism 204 comprising an elongated slot 206 to receive a pin 208. The apparatus 200 can also comprise the encoder strip 202 coupled to the locking mechanism 204. The apparatus 200 can further comprise a tension spring 210 coupled to the locking mechanism 204. The tension spring 210 can provide a force in a given direction (indicated by the arrow 212) to pull the locking mechanism 204 in the given direction. The force can cause creep in the encoder strip 202, such that the locking mechanism 204 is pulled to a position in which the pin 208 is rested at an edge 214 of the elongated slot 33 of the locking mechanism 204.

Figure 8:
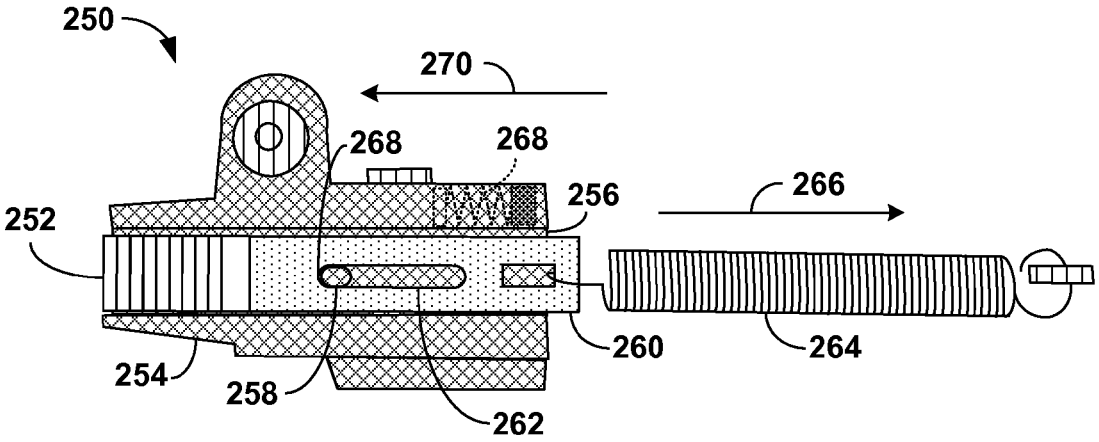
FIG. 8 illustrates yet another example of a system, such as the system of FIG. 1, to control stress on an encoder strip.

FIG. 8 illustrates yet another example of a system 250 (e.g., the system 2 illustrated in FIG. 1) that can control stress on a flexible encoder strip 252. The system 250 can comprise a guide 254 comprising a U-shaped section 256 and a pin 258 in the U-shaped section 256 of the guide 254 extending in a direction perpendicular to a face of the U-shaped section 256. The system 250 can also comprise a locking mechanism 260 positioned in the U-shaped section 256 of the guide 254 comprising an elongated slot 262 to receive the pin 258 of the guide 254. The flexible encoder strip 252 can be adhered to the locking mechanism 260. A portion of the flexible encoder strip 252 can be positioned in the U-shaped section 256 of the guide 254. The system 250 can also comprise a tension spring 264 coupled to the locking mechanism 260. The tension spring 264 can provide a force in a given direction (indicated by the arrow 266) to pull the locking mechanism 260 in the given direction. The system 250 can further comprise a compression spring 268 coupled to the guide 254. The compression spring 268 can apply a compression force in another direction (indicated by the arrow 270) opposing the given direction to push the guide 254 such that the pin 258 is nested at an edge of the elongated slot 262 of the locking mechanism 260.

Where the disclosure or claims recite "a," "an," "a first," or "another" element, or the equivalent thereof, it should be interpreted to include one or more than one such element, neither requiring nor excluding two or more such elements. Furthermore, what have been described above are examples. It is, of course, not possible to describe every conceivable combination of components or methods, but one of ordinary skill in the art will recognize that many further combinations and permutations are possible. Accordingly, the disclosure is intended to embrace all such alterations, modifications, and variations that fall within the scope of this application, including the appended claims.

What is claimed is:

1. An apparatus comprising:

a locking mechanism comprising an elongated slot to receive a pin;

an encoder strip coupled to the locking mechanism;

a tension spring coupled to the locking mechanism, wherein the tension spring is to provide a force in a given direction to pull the locking mechanism in the given direction, wherein the force causes creep on the encoder strip, such that the locking mechanism is pulled to a position in which the pin is rested at an edge of the elongated slot of the locking mechanism; and a compression spring to provide a compression force in another direction opposing the given direction, wherein the compression force causes the pin to nest at the edge of the elongated slot of the locking mechanism.

2. The apparatus of claim 1, wherein the guide is mechanically fastened to a sidewall of a printing assembly of a printer.

3. The apparatus of claim 2, further comprising an aligning mechanism to set a position of the guide and the pin on the sidewall of the printing assembly relative to the locking mechanism and the encoder strip.

4. The apparatus of claim 3, wherein the encoder strip extends through an aperture in the sidewall of the printing assembly.

5. The apparatus of claim 3, wherein the printer comprises a large format printer to print on paper at least about 609 mm (24 inches) wide.

6. The apparatus of claim 5, wherein the printer is a plotter.

7. A system comprising:

a guide comprising:

a U-shaped section; and a pin in the U-shaped section of the guide extending in a direction perpendicular to a face of the U-shaped section;

a locking mechanism positioned in the U-shaped section of the guide comprising an elongated slot to receive the pin of the guide;

a flexible encoder strip being adhered to the locking mechanism, wherein a portion of the flexible encoder strip is positioned in the U-shaped section of the guide; and a tension spring coupled to the locking mechanism, wherein the tension spring is to provide a force in a given direction to pull the locking mechanism in the given direction, a compression spring coupled to the guide, wherein the compression spring is to apply a compression force in another direction opposing the given direction to push the guide such that the pin is nested at an edge of the elongated slot of the locking mechanism.

8. The system of claim 7, wherein the encoder strip comprises Biaxially-oriented polyethylene terephthalate (BoPET) and the locking mechanism comprises a metal.

9. A printer comprising:

a printing assembly with a sidewall;

a guide mechanically fastened to the sidewall of the printing assembly, the guide comprising:

a U-shaped section; and a pin in the U-shaped section of the guide extending in a direction perpendicular to a face of the U-shaped section;

a locking mechanism formed from metal positioned in the U-shaped section of the guide comprising an elongated slot to receive the pin of the guide;

a flexible encoder strip formed from Biaxially-oriented polyethylene terephthalate (BoPET), the flexible encoder strip including a series of periodic dark lines, and the flexible encoder strip being adhered to the locking mechanism, wherein a portion of the encoder strip is positioned in the U-shaped section of the guide;

an aligning mechanism to set a position of the guide and the pin on the sidewall of the printing assembly relative to the locking mechanism and the flexible encoder strip; and a tension spring coupled to the locking mechanism, wherein the tension spring is to provide a force in a given direction to pull the locking mechanism in the given direction;

a compression spring to provide a compression force to the guide in a direction opposing the given direction, such that the pin of the guide is nested at an edge of the elongated slot of the locking mechanism;

wherein the printer is a large format printer with the capacity to print on paper at least 609 mm (24 inches) wide;

wherein the elongated slot is sufficiently wide such that the locking mechanism moves in another direction opposing the given direction in response to a force being applied to the encoder strip.

* * * * *